US009784088B2

(12) United States Patent
Samuel et al.

(10) Patent No.: US 9,784,088 B2
(45) Date of Patent: Oct. 10, 2017

(54) UNDERBALANCED DRILLING THROUGH FORMATIONS WITH VARYING LITHOLOGIES

(71) Applicant: Landmark Graphics Corporation, Houston, TX (US)

(72) Inventors: Robello Samuel, Cypress, TX (US); Gabriela M Morales-Ocando, Katy, TX (US); Aniket Aniket, Houston, TX (US)

( * ) Notice: Subject to any disclaimer, the term of this patent is extended or adjusted under 35 U.S.C. 154(b) by 0 days.

(21) Appl. No.: 15/035,449

(22) PCT Filed: Jul. 13, 2015

(86) PCT No.: PCT/US2015/040191
§ 371 (c)(1),
(2) Date: May 9, 2016

(87) PCT Pub. No.: WO2017/010985
PCT Pub. Date: Jan. 19, 2017

(65) Prior Publication Data
US 2017/0167240 A1 Jun. 15, 2017

(51) Int. Cl.
*E21B 21/08* (2006.01)
*E21B 44/00* (2006.01)
*E21B 41/00* (2006.01)

(52) U.S. Cl.
CPC ..... *E21B 44/00* (2013.01); *E21B 21/08* (2013.01); *E21B 41/0092* (2013.01)

(58) Field of Classification Search
None
See application file for complete search history.

(56) References Cited

U.S. PATENT DOCUMENTS 5,305,836 A * 4/1994 Holbrook ..... E21B 12/02 175/26
5,415,030 A * 5/1995 Jogi ..... E21B 12/02 175/39
7,032,689 B2 * 4/2006 Goldman ..... E21B 12/02 175/39
7,261,167 B2 * 8/2007 Goldman ..... E21B 12/02 175/39
8,949,098 B2 * 2/2015 King ..... E21B 12/02 703/10
9,394,783 B2 * 7/2016 Rasmus ..... E21B 47/06
2005/0092522 A1 5/2005 Humphreys
2005/0192855 A1 9/2005 Chitty et al.
2009/0107723 A1 * 4/2009 Kusko ..... E21B 1/00 175/25

(Continued)

FOREIGN PATENT DOCUMENTS

WO 0214649 A1 2/2002
WO 2015080736 A1 6/2015

OTHER PUBLICATIONS

Institut National de la Propriete Industrielle, Demande de brevet d'invention No. 16 55434, which is an FR counterpart to the instant application, Oct. 28, 2016.

(Continued)

*Primary Examiner* — Shane Bomar
(74) *Attorney, Agent, or Firm* — Howard L. Speight, PLLC

(57) ABSTRACT

Bottom-hole pressure operating envelops for underbalanced drilling take into account the lithologies of the formations being drilled through.

20 Claims, 13 Drawing Sheets

(56) References Cited

U.S. PATENT DOCUMENTS

| | | | | |
|---|---|---|---|---|
| 2014/0124265 | A1 | 5/2014 | Al-Yami et al. | |
| 2014/0291023 | A1* | 10/2014 | Edbury | E21B 44/00 175/24 |
| 2016/0201445 | A1* | 7/2016 | Robello | E21B 44/00 703/7 |
| 2017/0037691 | A1* | 2/2017 | Savage | E21B 21/08 |
| 2017/0074085 | A1* | 3/2017 | Samuel | E21B 43/30 |

OTHER PUBLICATIONS

International Searching Authority, Patent Cooperation Treaty, International Search Report and Written Opinion, International application No. PCT/US2015/040191, which is a PCT parent to the instant application, Apr. 1, 2016.

Kenneth E. Gray, The California Co. The Cutting Carrying Capacity of Air at Pressures above Atmospheric, vol. 213, 2958, p. 185.

Sze-Foo Chien, Laminar Flow Pressure Loss and Flow Pattern Transition of Bingham Plastics in Pipes and Annuli, SPE 2459.

Thomas R. Sifferman, Geore M. Meyers, Elard L. Haden, Harry A. Wahl, Society of Petroleum Engineers of AIME, Sep. 30, 1973, Paper No. SPE 4514.

* cited by examiner

| TVD (ft) | MD (ft) | Name | Lithology |
|---|---|---|---|
| 520.0 | 520.3 | St. Eugene | GRAVEL |
| 1000.0 | 1000.9 | Gishenana | GRAVEL |
| 3000.0 | 3003.7 | Paskapoo | SILTSTONE |
| 3200.0 | 3204.7 | Willow Creek | SANDSTONE |
| 4000.0 | 4012.7 | Edomonton | SANDSTONE |
| 4200.0 | 4216.2 | Bearpaw | SHALE |
| 4500.0 | 4522.7 | Blairmore | SILTSTONE |
| 5000.0 | 5037.9 | Tunnel Mnt. | SANDSTONE |
| 6000.0 | 6213.0 | Stephen | SHALE |

TABLE 3.1—SPHERICITIES OF VARIOUS PARTICLE SHAPES

| Shape | Aspect Ratio | Sphericity, $\Psi$ |
|---|---|---|
| Sphere | | 1.00 |
| Octahedron | | 0.85 |
| Prism | $L \times L \times L$ | 0.81 |
| | $L \times L \times 2L$ | 0.77 |
| | $L \times 2L \times 2L$ | 0.76 |
| | $L \times 2L \times 3L$ | 0.73 |
| Cylinder | $H = R/15$ | 0.28 |
| | $H = R/10$ | 0.32 |
| | $H = R/3$ | 0.59 |
| | $H = R$ | 0.83 |
| | $H = 2 \times R$ | 0.87 |
| | $H = 3 \times R$ | 0.86 |
| | $H = 10 \times R$ | 0.69 |
| | $H = 20 \times R$ | 0.58 |

UNDERBALANCED DRILLING THROUGH FORMATIONS WITH VARYING LITHOLOGIES

BACKGROUND

Pore pressures and fracture pressures in oil and gas wells vary with depth. The pore pressure at a particular depth is defined to be the pressure exerted by the fluid in the formation at that depth into a well's borehole. Formation fluids will escape into the borehole if the pressure exerted by drilling fluids in the well's borehole is less than the pore pressure. The fracture pressure at a particular depth is the pressure of the drilling fluids in the borehole that can fracture the formation at that depth.

An oil well being drilled is considered underbalanced if the pressure exerted by the drilling fluids is slightly less than the pore pressure. Drilling an underbalanced well is challenging when the well passes through a number of formations having different lithologies.

DETAILED DESCRIPTION

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment but should be assumed to be capable of association with any embodiment discussed herein.

Further, while this disclosure describes a land-based drilling system, it will be understood that the equipment and techniques described herein are applicable in sea-based systems, multilateral wells, all types of drilling systems, all types of rigs, measurement while drilling ("MWD")/logging while drilling ("LWD") environments, wired drillpipe environments, coiled tubing (wired and unwired) environments, wireline environments, and similar environments.

Figure 1:
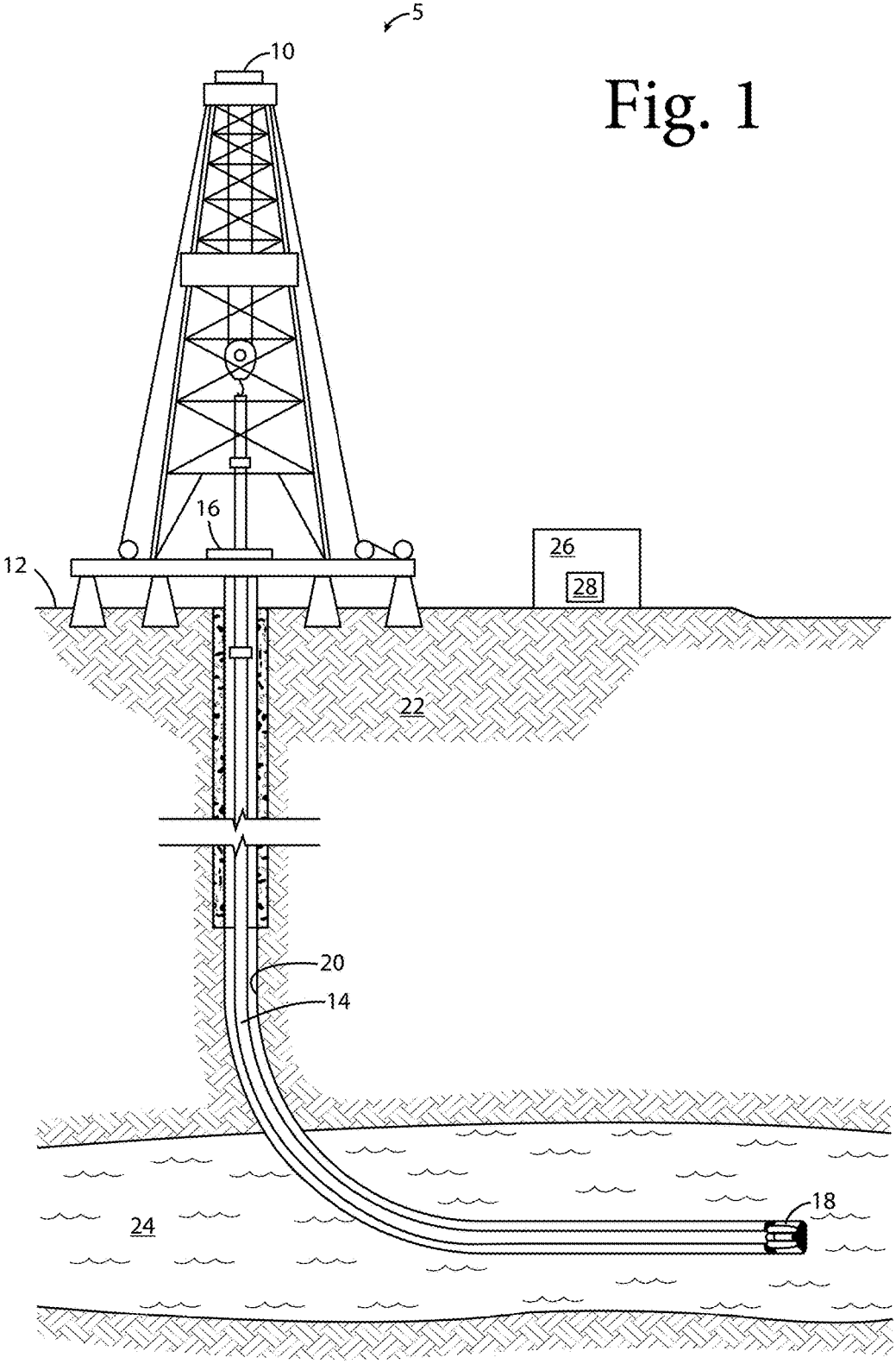
FIG. 1 is a schematic of a drilling system.
Figure 2A:
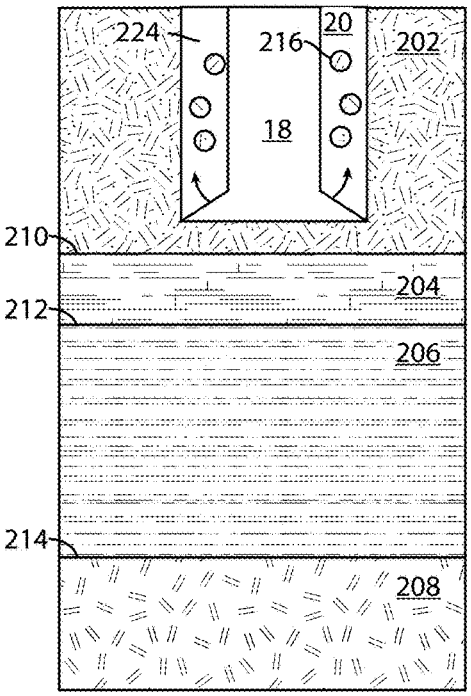
FIG. 2A is a cross-sectional view of a borehole and the resulting cuttings as it is being drilled through a first formation.
Figure 2B:
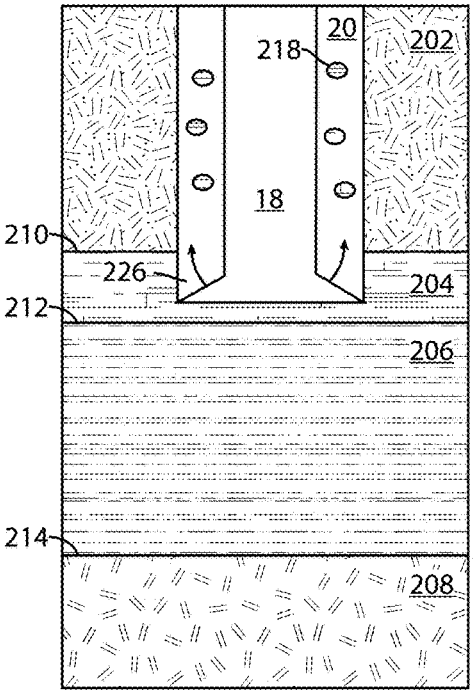
FIG. 2B is a cross-sectional view of a borehole and the resulting cuttings as it is being drilled through a second formation.
Figure 2C:
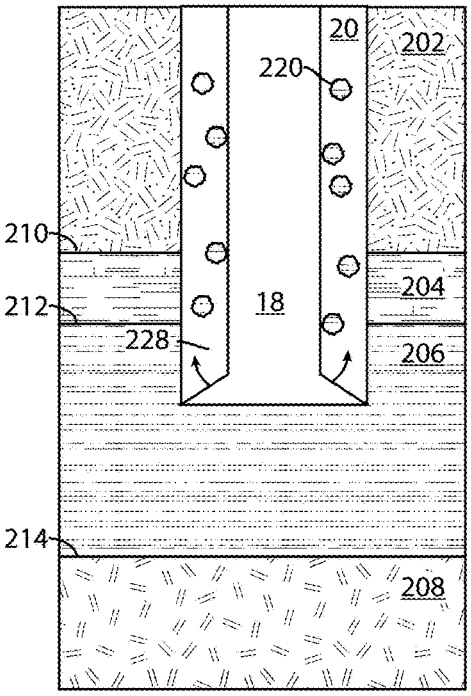
FIG. 2C is a cross-sectional view of a borehole and the resulting cuttings as it is being drilled through a third formation.
Figure 2D:
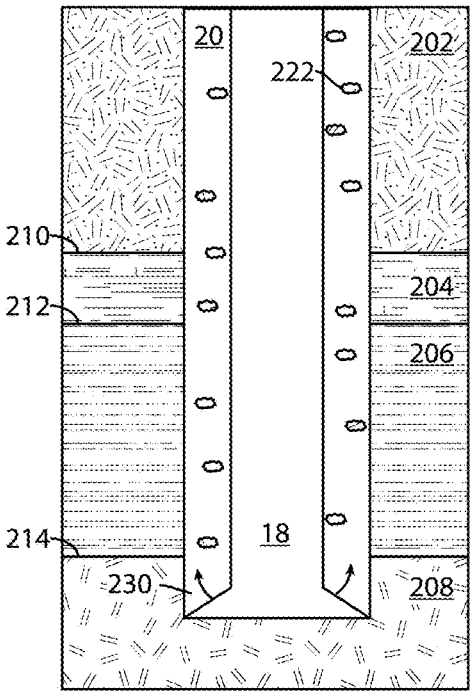
FIG. 2D is a cross-sectional view of a borehole and the resulting cuttings as it is being drilled through a fourth formation.

A system for drilling operations (or "drilling system") 5, illustrated in FIG. 1, includes a drilling rig 10 at a surface 12, supporting a drill string 14. The drill string 14 may be an assembly of drill pipe sections which are connected end-to-end through a work platform 16. The drill string may comprise coiled tubing rather than individual drill pipes. A bottom-hole assembly (BHA) 18 may be coupled to the lower end of the drill string 14. The BHA 18 creates a borehole 20 through numerous earth formations, represented in FIG. 1 by formations 22 and 24. The BHA 18 may include a number of sensors (such as pressure sensors, temperature sensors, and the like).

A surface processor 26 may receive signals from the BHA sensors and other sensors along the drill string and use the signals to characterize the borehole 20 as it is being drilled.

A model 28 of the borehole 20 to be drilled may be prepared. The model 28 may reside on the surface processor 26 or at a remote location (not shown). The model may be used in planning or it may be used in monitoring and controlling the drilling of the borehole 20.

The model may include an estimate of the downhole pressure along the borehole 20, particularly in underbalanced drilling (UBD) operations in which downhole pressure is maintained close to the pore pressure. The model 28 accounts for dynamic cuttings loading during drilling operations. Based on the formation type, the model uses different correlations to understand the influence of the characteristics of cuttings produced by drilling and also estimates the minimum flow rate required to achieve efficient hole cleaning. A dynamic three dimensional operating envelop for optimum UBD operations is estimated utilizing these more accurate downhole pressure and minimum flow rate calculations as the borehole is drilled through various formations at underbalanced conditions to achieve a target depth.

The problem is illustrated in FIGS. 2A-2D. The BHA is shown drilling through four formations 202, 204, 206 and 208 producing cuttings from each of the formations. Formation 204 has a formation top 210, which is the depth at which the BHA 18 will enter formation 204. Formation 206 has a formation top 212, which is the depth at which the BHA 18 will enter formation 206. Formation 208 has a formation top 214, which is the depth at which the BHA 18 will enter formation 208. Formations 202, 204, 206, and 208 have different lithologies as represented by the patterns in their representations.

Cuttings 216 are produced from formation 202, cuttings 218 are produced from formation 204, cuttings 220 are produced from formation 206, and cuttings 222 are produced from formation 208. The cuttings 216, 218, 220, and 222 may have different characteristics. The difference in characteristics is illustrated in FIGS. 2A-2D by the smooth, spherical shape of cuttings 216, the smooth ovoid shape of cuttings 218, the rough spherical shape of cuttings 220, and the rough ovoid shape of cuttings 222. It will be understood that the representations are merely symbolic of actual characteristics of the cuttings.

As can be seen in FIGS. 2A-2D, annular volumes 224, 226, 228, 230 adjacent to the BHA 18 are created as the borehole 20 is being drilled through formation 202, formation 204, formation 206, and formation 208, respectively. The borehole pressure at the bottom of the BHA 18 (the "bottom-hole pressure") is affected by a number of factors, including the lithology of the cuttings in the formation currently being penetrated by the BHA 18. Part of the process of underbalanced drilling is modeling and controlling bottom-hole pressure, including taking into consideration the lithology of the cuttings 216, 218, 220, 222.

Figure 3:
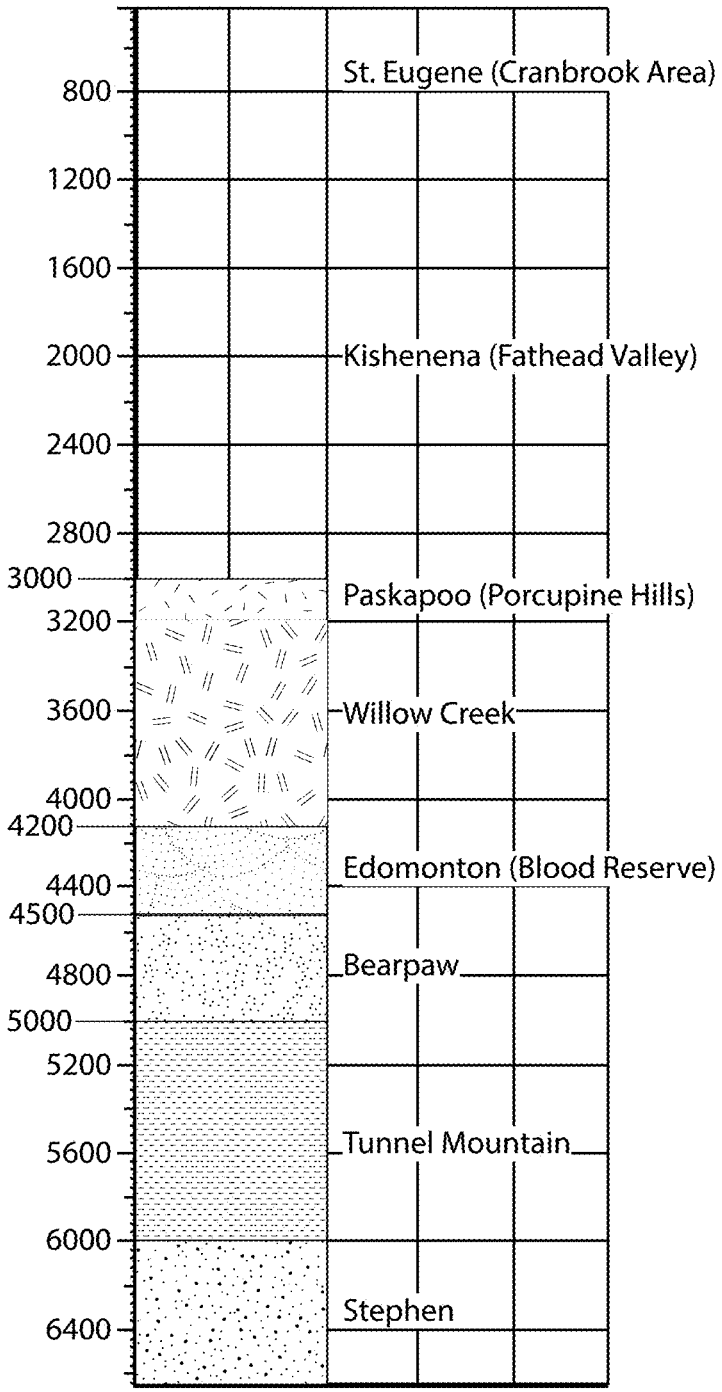
FIG. 3 is a representation of a formation top column.
Figure 4:
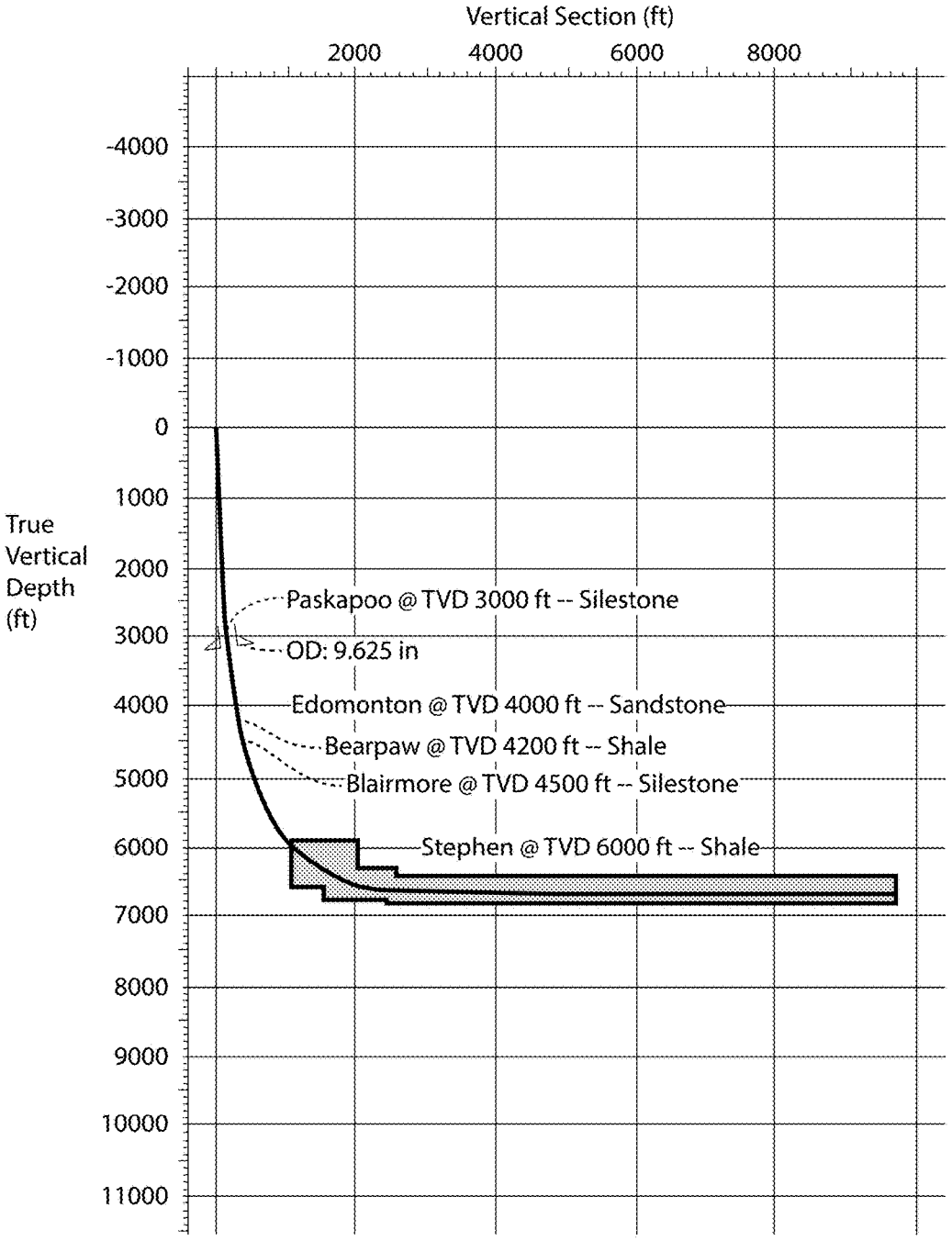
FIG. 4 is a representation of a horizontal well that crosses at least 4 formations while being drilled.

The model 28 may include a formation top column, as shown in FIG. 3, in which the vertical axis is measured depth. The formation top column includes formation tops for each of the formations to be drilled through as the borehole 20 is being drilled. FIG. 4 shows an example of a horizontal borehole that is crossing at least five formations (i.e., Paskapoo, Edomonton, Bearpaw, Blairmore, and Stephen) while being drilled. Each of the formations may have a different lithology as shown in FIG. 4 (i.e., Paskapoo having a silestone lithology, Edomonton having a sandstone lithology, Bearpaw having a shale lithology, Blairmore having a silestone lithology, and Stephen having a shale lithology). Details of the formation tops is shown in Table 1 below (where true vertical depth is abbreviated TVD and measured depth is abbreviated MD and both are measured in feet):

TABLE 1

| TVD | MD | Name | Lithology |
|---|---|---|---|
| 520.0 | 520.3 | St. Eugene (cranbrook) | GRAVEL |
| 1000.0 | 1000.9 | Kishenena (Fathead) | GRAVEL |
| 3000.0 | 3003.7 | Paskapoo (Porkupine) | SILTSTONE |
| 3200.0 | 3204.7 | Willow Creek | SANDSTONE |
| 4000.0 | 4012.7 | Edomonton (Blood) | SANDSTONE |
| 4500.0 | 4522.7 | Blairmore | SILESTONE |
| 5000.0 | 5037.9 | Tunnel Mountain | SANDSTONE |
| 6000.0 | 6213.0 | Stephen | SHALE |

Figure 5:
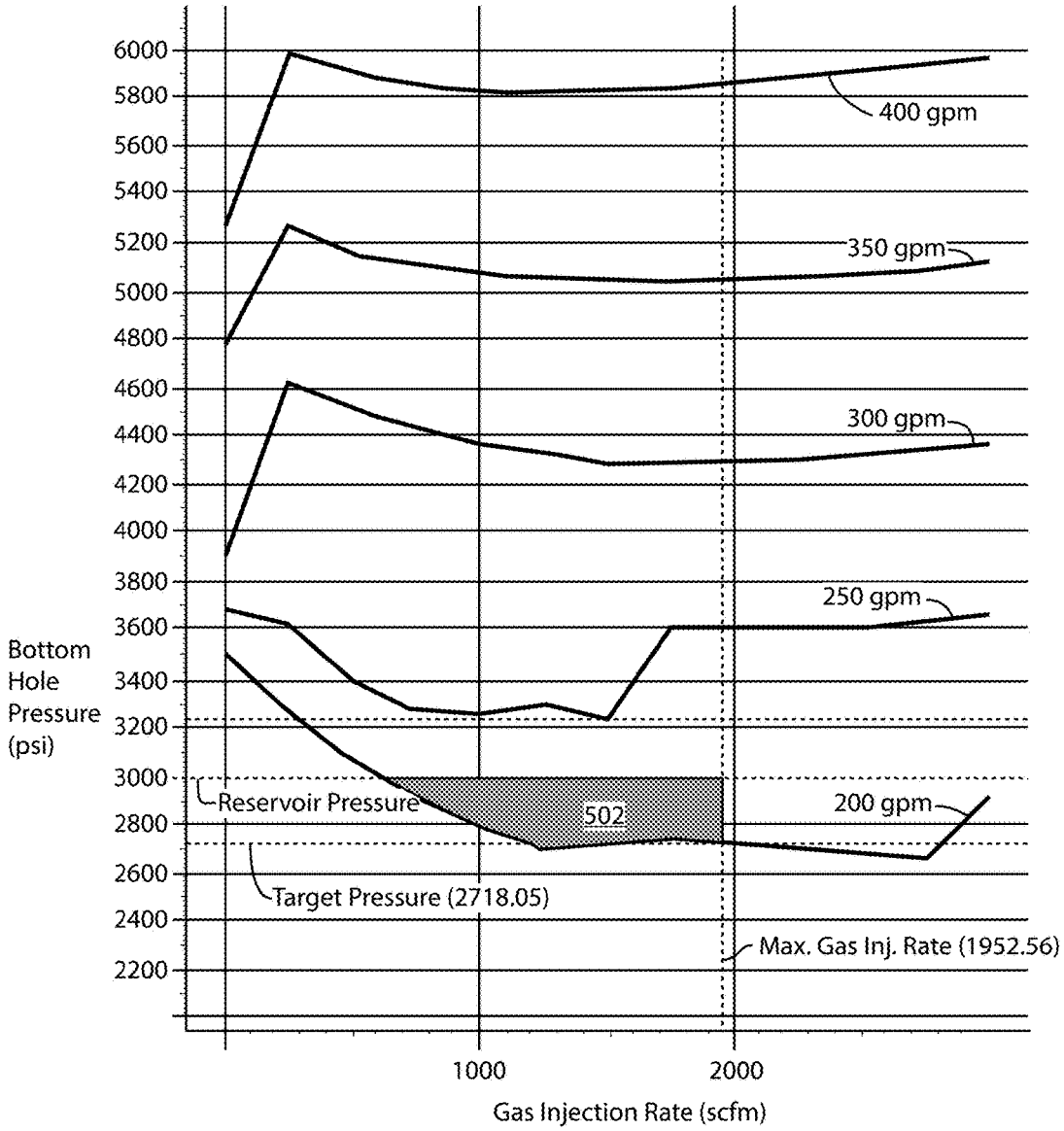
FIG. 5 is an illustration of a two dimensional operating envelop.

The model 28 may include an operating envelop 502, as shown in FIG. 5, that defines the conditions for the borehole 20 being drilled under which the bottom-hole pressure is in an underbalanced condition. In FIG. 5, the vertical axis is the bottom-hole pressure in pounds per square inch (psi), as described above, and the horizontal axis is the gas injection rate in standard cubic feet per minute (scfm). The gas injection rate is the rate at which an inert gas is injected into the drilling mud to reduce its density and hence the hydrostatic pressure.

FIG. 5 also shows the liquid pumping rate, which is the rate at which drilling fluids are pumped into the drill string 14 and ultimately into the borehole 20 through ports in the BHA 18. In the example shown in FIG. 5, five liquid pumping rates (200 gallons per minute (gpm), 250 gpm, 300 gpm, 350 gpm, and 400 gpm) are illustrated. The target pressure (2718.05 psi) and the reservoir pressure (3000 psi) are represented by dashed horizontal lines. The maximum gas injection rate (1952.56 scfm) is represented by a dashed vertical line.

The operating envelop 502 is bounded by (1) the minimum liquid pumping rate (200 gpm) that maintains the bottom-hole pressure above the target pressure over the range of available gas injection rates, (2) the maximum gas injection rate, and (3) the reservoir pressure.

Figure 6:
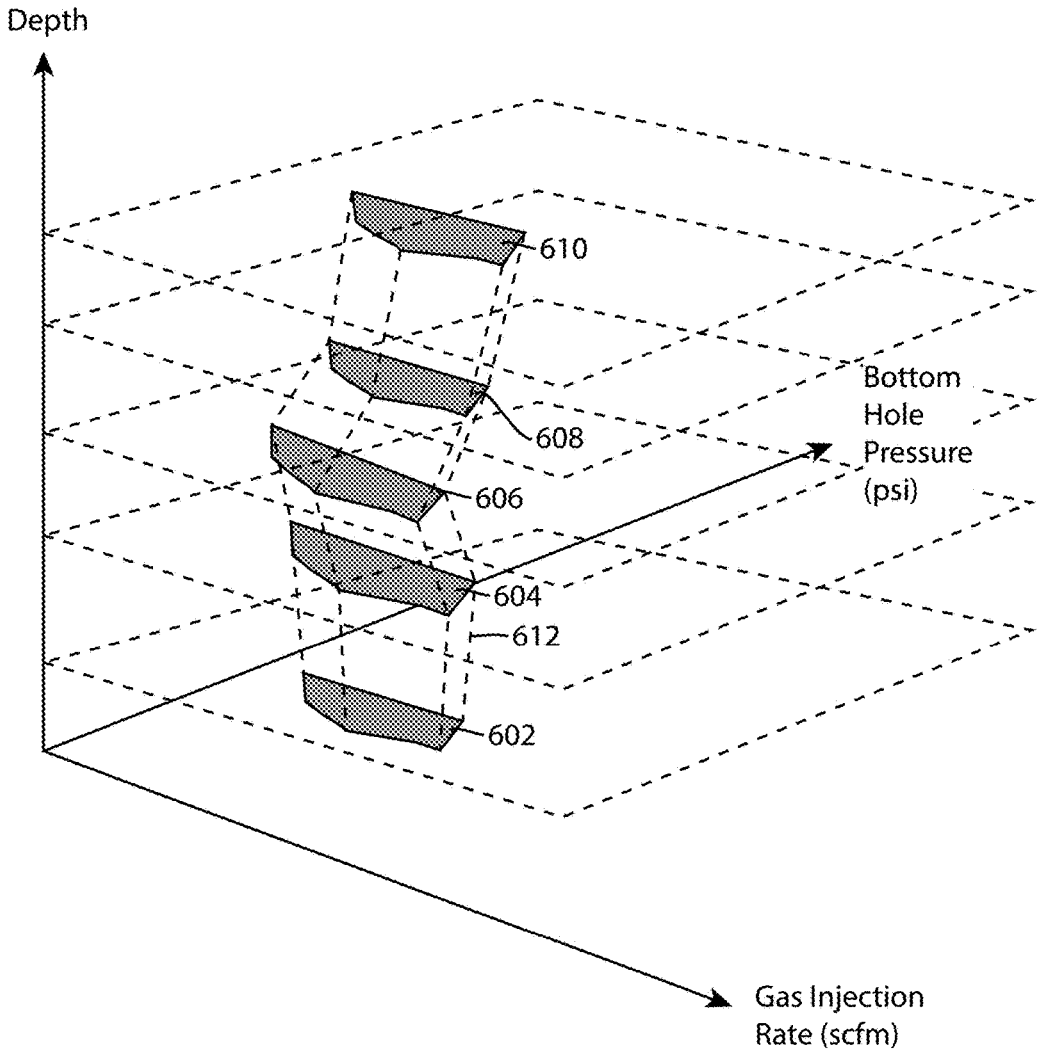
FIG. 6 is an illustration of a three dimensional operating envelop.

FIG. 6 is an illustration of a three dimensional operating envelop. Two dimensional operating envelops 602, 604, 606, 608, and 610 are computed at formation tops (or at predetermined depths within the formations). The envelops 602, 604, 606, 608, and 610 are connected as shown in FIG. 6 to create a three dimensional operating envelop 612.

Figure 7:
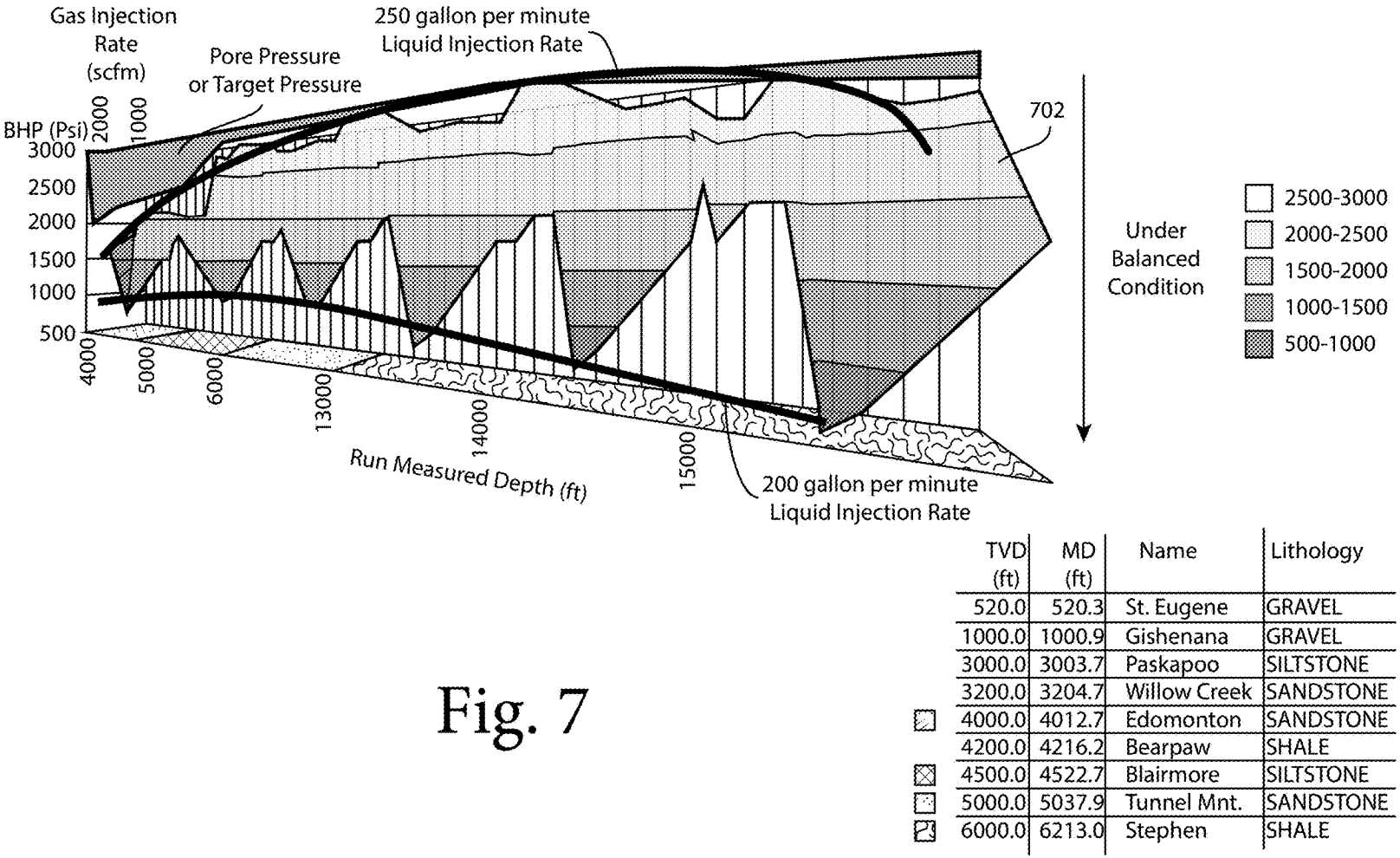
FIG. 7 illustrates a model.

The model 28, illustrated in FIG. 7, shows a drilling interval from 4000 feet to 1500 feet, as shown on the Run Measured Depth axis. Different formations having different lithologies are to be encountered during drilling, as indicated by the patterns on the lower wall of FIG. 7. The lithology of the formations is shown in a legend in the lower right corner of FIG. 7. The top wall of FIG. 7 is a surface representing pore pressure or target pressure, where one or the other is chosen for display by a user. A surface 702 represents the variations in bottom-hole pressure with the scale being the vertical axis on the right side of FIG. 7. The bottom-hole pressure varies as a result of the operational parameters and conditions such as: liquid injection rate (shown by the heavy curves in FIG. 7), gas injection rate (shown on the Z axis in FIG. 7), multiphase modeling, temperature profile, and lithological conditions (as shown at the bottom of FIG. 7). For every formation being intercepted, a different cutting loading effect is defined to account for the cuttings characteristics specific to that particular formation.

The model 28 may display an operating envelop, such as two dimensional operating envelop 502, three dimensional operating envelop 612, or three dimensional operating envelop 702, as the borehole 20 is being drilled. The bottom-hole pressure is calculated at the base of the formation top, bottom-hole pressure is calculated, and the three dimensional operating envelop is displayed.

The procedure is as follows:

1. Define the formation tops along with their lithologies.
2. Define open hole sections for formation tops:
   a. The target pressure can be defined by formation top or a unique delta pressure below the pore pressure can be defined.
   b. Include and define cuttings loading option for every hole section.
   c. A combobox will allow the user to select from a list of available lithologies.
   d. If the drilling parameters and cuttings dimensions (rate of penetration, cuttings density and diameter) are different within the same formation top, the user can decide to split the hole section as needed.
   e. Once the hole section is defined and the rest of the input data, such as mud motor information, injection and pumping conditions and rate, surface line dimensions, multiphase flow model and temperature profile, are set, the operational envelop on run measured depth (as the borehole is being drilled) by interlayer formation will be displayed.

Figure 8A:
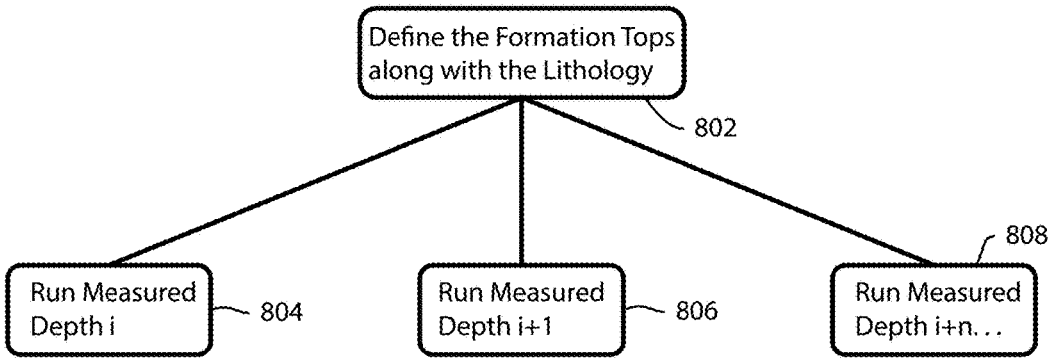
FIG. 8A is a portion of a flowchart for the computation of a bottom hole pressure at a plurality of measured depths.

The computation of a bottom-hole pressure at a plurality of measured depths is illustrated in FIGS. 8A-8D. The computation includes executing a "defining the formation tops along with lithology" process (block 802) which uses information from a "run measured depth" process run at depth i (block 804), depth i+1 (block 806), and at all other depths of interest (block 808), as shown in FIG. 8A.

Figure 8B:
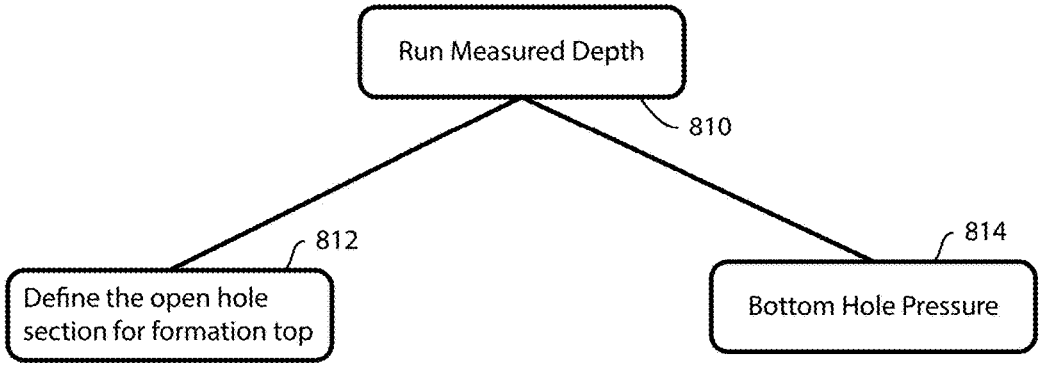
FIG. 8B is a portion of a flowchart for the computation of a bottom hole pressure at a plurality of measured depths.

The "run measured depth" process (block 810), shown in more detail in FIG. 8B, uses information from a "define the open hole section for formation top" process (block 812) and a "bottom hole pressure" process (block 814).

Figure 8C:
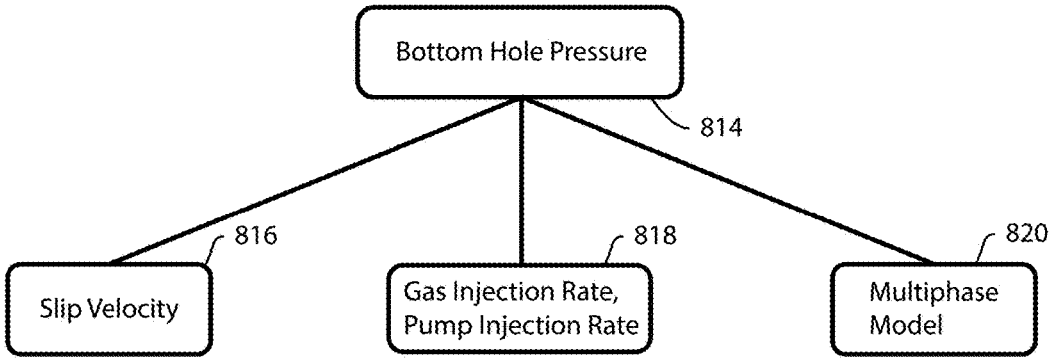
FIG. 8C is a portion of a flowchart for the computation of a bottom hole pressure at a plurality of measured depths.

The "bottom hole pressure" process (block 814), shown in more detail in FIG. 8C, uses information from a "slip velocity" process (block 816), the gas injection rate and the pump injection rate (block 818), and a "multiphase model" (block 820).

Figure 8D:
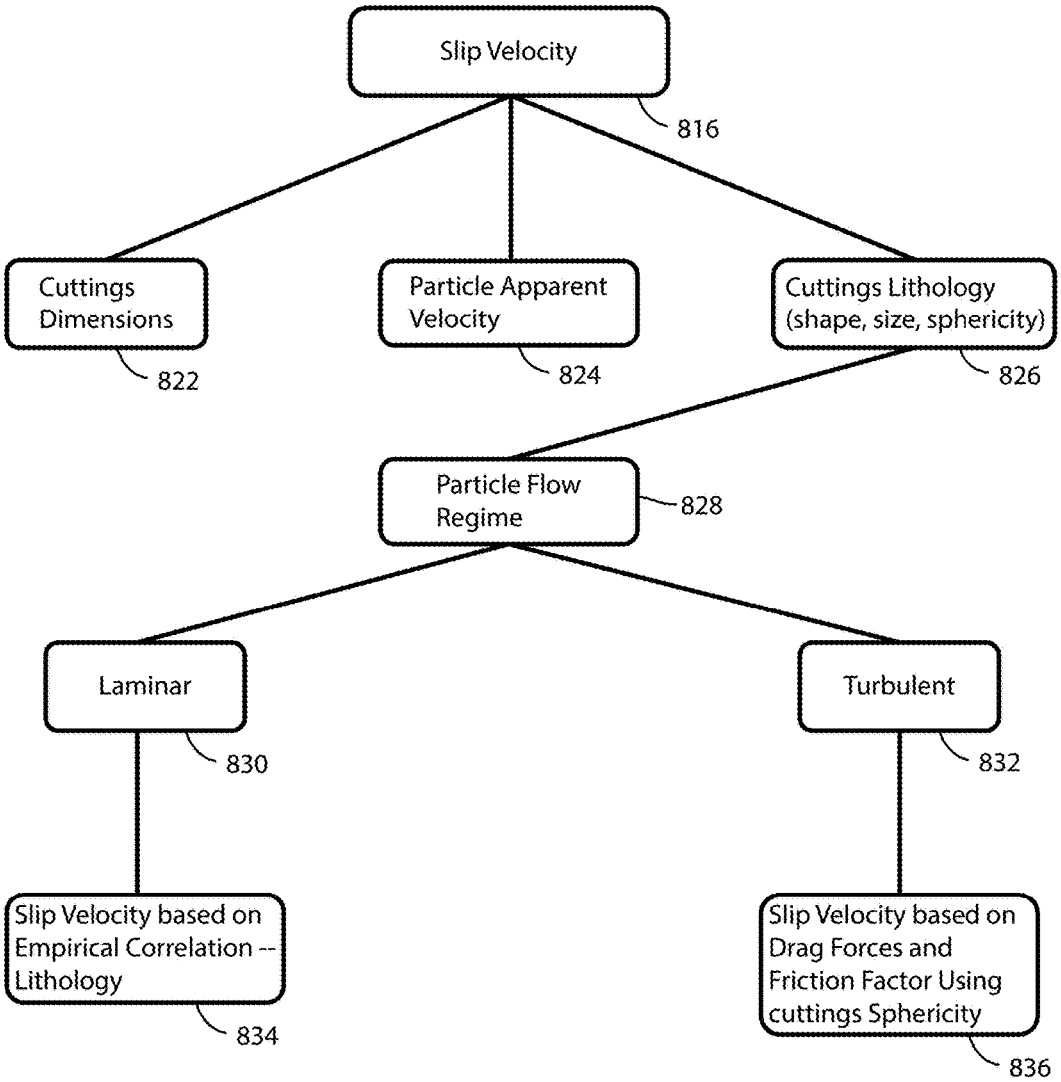
FIG. 8D is a portion of a flowchart for the computation of a bottom hole pressure at a plurality of measured depths.

The "slip velocity" process (block 816), shown in more detail in FIG. 8D, uses the cuttings dimensions (block 822), the particle apparent velocity (block 824), and a "cuttings lithology" process (block 826), where cuttings lithology is defined to be the shape, size, and lithology of the cuttings. The "cuttings lithology" process (block 826) uses information from a "particle flow regime" process (block 828). The "particle flow regime" process (block 828) uses information from a "laminar" process (block 830), if the particle flow is expected to be laminar, and a "turbulent" process (block 832) if the particle flow is expected to be turbulent. If the "laminar" process (block 830) is executed, slip velocity is computed as an empirical correlation based on lithology (block 834). If the "turbulent" process (block 832) is executed, slip velocity is based on drag forces and friction factors using the sphericity of the cuttings (block 836).

Figure 9:
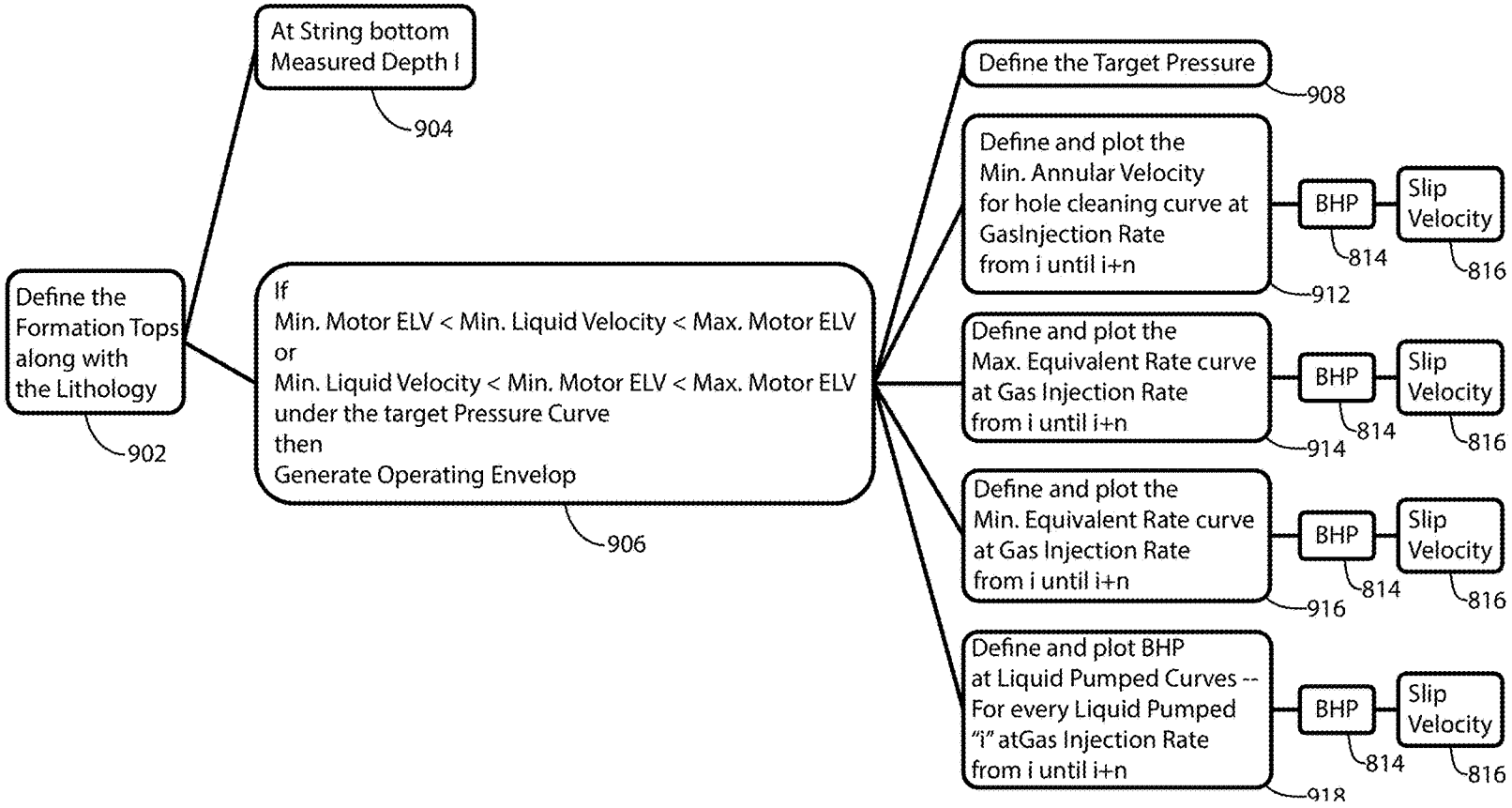
FIG. 9 is a flowchart for the computation of a two dimensional operating envelop that takes cuttings lithology into consideration.

The computation of a two dimensional operating envelop (such as element 502 in FIG. 5 and elements 602, 604, 606, 608, and 610 in FIG. 6) that takes cuttings lithology into consideration, shown in FIG. 9, defines the formation tops along with lithology (block 902) at string bottom measured depth "I" (block 904). The process generates the operating envelop if (block 906):

- the minimum motor equivalent liquid flow rate (abbreviated in FIG. 9 as "Min. Motor ELV")<the maximum motor equivalent liquid low rate (abbreviated in FIG. 9 as "Max Motor ELV") or
- the minimum liquid velocity (abbreviated in FIG. 9 as "Min. Liquid Velocity")<the minimum motor equivalent liquid flow rate<the maximum motor equivalent liquid low rate.

The process for generating the operating envelop (block 906) uses:

- a defined target pressure (block 908),
- a minimum annular velocity for hole cleaning at gas injection rates from i until i+n (block 912),
- a maximum equivalent rate curve at gas injection rates from i until i+n (block 914),
- a minimum equivalent rate curve at gas injection rates from i until i+n (block 916), and
- a bottom-hole pressure at liquid pumped curves for every liquid pumped "i" at gas injection rates from i until i+n (block 918).

Blocks 912, 914, 916, and 918 use the bottom-hole pressure (BHP) (block 814), see FIG. 8C, which, in turn, is based in part on slip velocity (block 816), see FIG. 8C.

Figure 10:
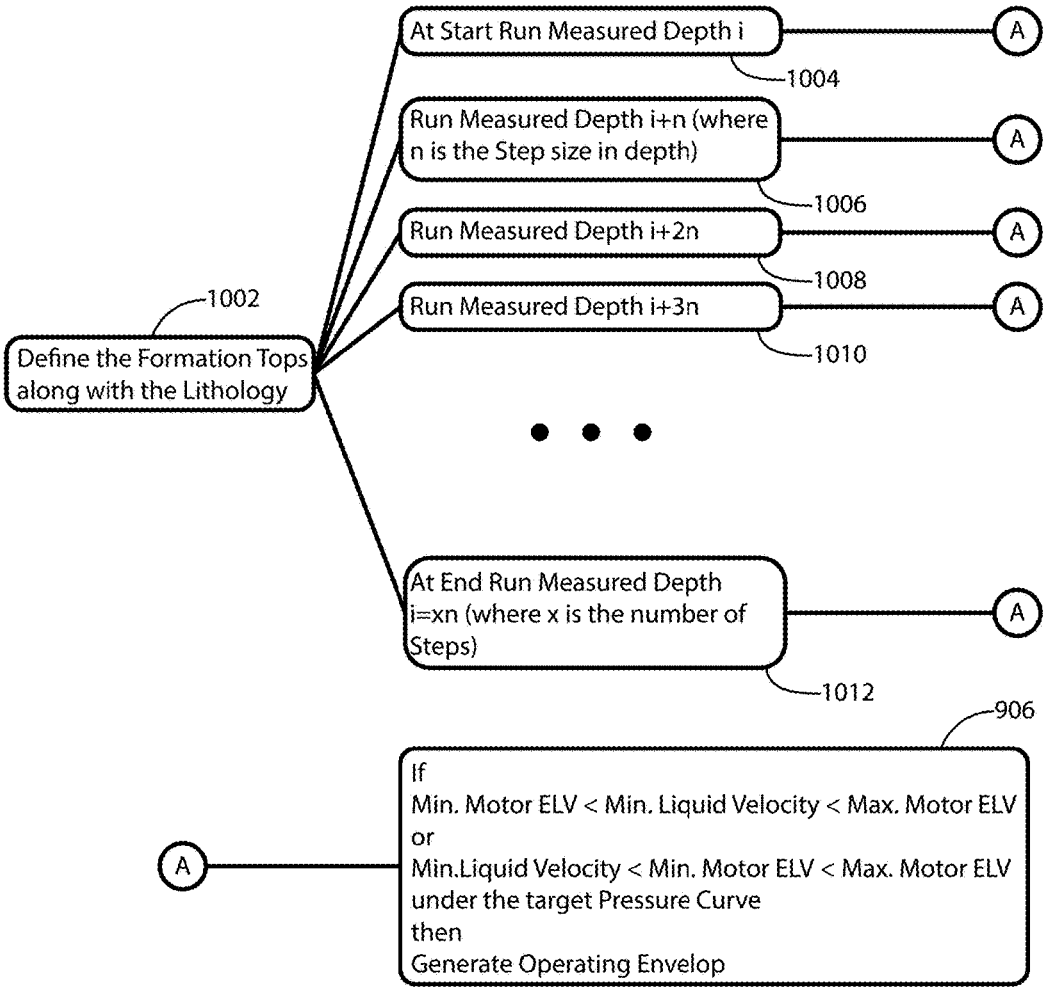
FIG. 10 is a flowchart for the computation of a three dimensional operating envelop that takes cuttings lithology into consideration.

The computation of a three dimensional operating envelop (such as element 612 in FIG. 6 or element 702 in FIG. 7) that takes cuttings lithology into consideration, shown in FIG. 10, defines the formation tops along with lithology (block 1002). This process uses the operating envelop generated using the process and under the conditions defined in block 906, see FIG. 9, for measured depth i (block 1004), where i is the initial depth, measured depth i+n (block 1006), where n is the step size in depth, measured depth i+2n (block 1008), measured depth i+3n (block 1010), and so on, through measured depth i+xn (block 1012), where x is the number of steps.

Options for a user interface include:

- two dimensional or three dimensional view,
- the two dimensional view will correspond to a predefined gas and injection rate per hole section,
- the two dimensional view will show the formation top column and the lithology per hole section,
- the Y axis will display the run measured depth,
- the X axis will display the annular bottom-hole pressure.

For the three dimensional view, in addition to what is included on the two dimensional view, the user will define a range of liquid and gas injection/pumping rates:

- the Z axis will be the gas injection rate,
- the Y axis will display the run measured depth,
- the X axis will display the annular bottom-hole pressure,
- the pumping liquid rate will be displayed,
- the formation tops will be displayed, and
- the user can decide whether to have the target pressure or the pore pressure displayed for every formation top.

The calculation of the operating envelop based on a cuttings slip model specific to a geological formation uses empirical correlations that describe the effect given by different formations: shale, sandstone, and limestone. For positive cuttings transport ratios, cuttings will be transported to the surface. Otherwise, they will remain in the borehole.

Particle slip velocity, as determined in FIG. 8D (element 816) and used in FIG. 8C, is defined as the rate at which a cutting of a given diameter and specific gravity settles out of a fluid. Slip velocity may be determined using Moore's correlation (from PetroWiki article on Cuttings transport, http://petrowiki.org/Cuttings_transport, accessed on Jun. 7, 2015):

$$\mu_a = \frac{K}{144}\left(\frac{D_h - D_p}{U_a}\right)^{1-n}\left(\frac{2+1/n}{0.0208n}\right)^n \tag{1}$$

where $\mu_a$=apparent viscosity, Pa-s;
K=consistency index for pseudoplastic fluid, Pa-s$^n$;
n=power law index;
$D_o$=annulus inside diameter in meters;
$D_i$=annulus outside diameter in meters;
and
v=annulus average flow velocity.

Figure 11:
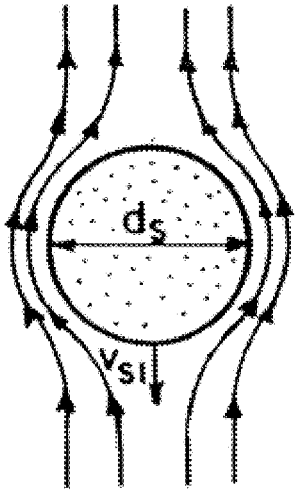
FIG. 11 shows a particle experiencing laminar flow.

The terminal velocity (Reynolds number) of a small spherical particle settling (i.e., slipping) through Newtonian fluid under laminar flow conditions, as shown in FIG. 11, is given by Stoke's Law. Stoke's Law gives acceptable accuracy for Reynolds numbers for a particle <0.1.

Figure 12:
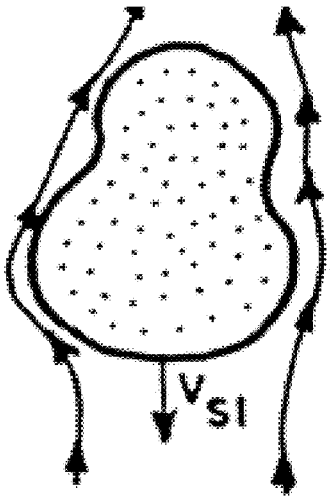
FIG. 12 shows a particle experiencing turbulent flow.
Figure 13:
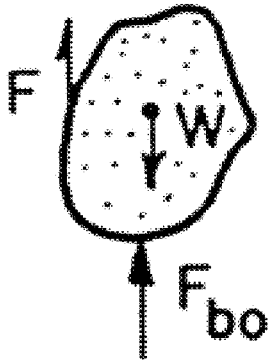
FIG. 13 shows a particle experiencing turbulent flow.

For turbulent slip velocities, where the Reynolds number is >0.1, such as is shown in FIGS. 12 and 13, an empirical friction factor may be used. For turbulent slip velocities, the drag force is given by:

$$F_d = \frac{\pi}{8} f \rho_f v_{st}^2 d_s \tag{2}$$

where "f" is an empirically determined friction factor as a function of the particle Reynolds number and the shape of the particle given by ψ, the "sphericity."

Figures 14, 15:
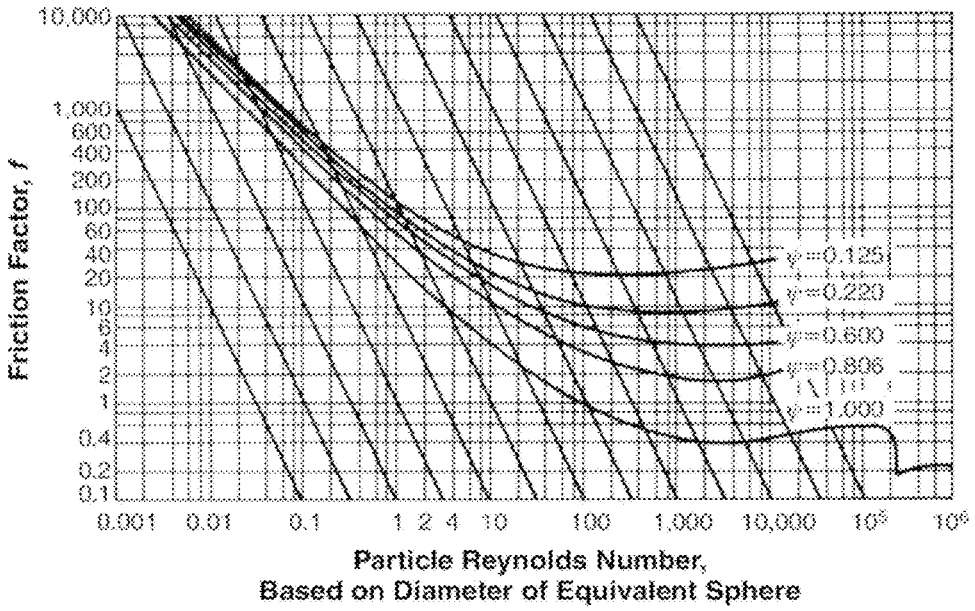
FIG. 14 shows the relationship between particle shape and sphericity.
FIG. 15 shows the relationship between Reynolds number, sphericity, and friction factor.

Sphericity can be determined using a lookup table such as that shown in FIG. 14. Once that is known, the particle Reynolds Number can be derived from a set of curves, such as those shown in FIG. 15. FIGS. 14 and 15 are from Sifferman, T. R., Myers, G. M., Haden, E. L. et al. 1974, "Drill Cutting Transport in Full Scale Vertical Annuli," J. Pet. Tech. 26 (11): 1295-1302. SPE-4514.

For the slip velocity calculations: given a solid particle defined by a drilled interval, calculate a slip velocity using the empirical correlations derived by Gray, K. E.: "The Cutting Carrying Capacity of Air at Pressures Above Atmospheric," Petroleum Transactions AIME, vol. 213, pp. 180 (1958) then determine the cuttings transport ratio for laminar flow.

For shale and limestone formations (flat particles)(Gray, equation 7):

$$V_{si} = 1.6\left[D\left(\frac{0.371T\rho s}{P}\right) - 1\right]^{1/2} \tag{3}$$

where:
$V_{si}$ is the slip velocity,
D is the particle diameter,
T is local temperature,
$\rho_s$ is cuttings density, and
P is local pressure.

For sandstone (sub-rounded particles)(Gray equation 9):

$$V_{si} = 2.1\left[D\left(\frac{.271T\rho s}{P} - 1\right)\right]^{1/2} \tag{4}$$

For turbulent flow (Gray equation 20 rearranged):

$$V_{si} = \left[\frac{4(\rho_s - \rho_f)gD}{3\rho_f f_D}\right] \tag{5}$$

where:
where:
g is the gravitational constant,
$\rho_f$ is fluid density,
$f_D$ is the friction factor.
Then define the cuttings ratio as:

$$F_t = 1 - \frac{V_{si}}{\mu_a} \tag{6}$$

$F_t$ gives an indication of the amount of cuttings being removed from the annular space. If $F_t$ is close to 1, the liquid phase is transporting the cuttings (the solid phase) out of the annular space. If $F_t$ is close to zero, the velocity of the liquid phase is not enough to remove the cuttings.

In the case of the non-Newtonian fluids, new factors need to be accounted for the particle-settling calculation. For Bingham fluids, the particle will remain suspended with no settling if:

$$\tau_y \geq \frac{d_z}{6}(\rho_s - \rho_f). \tag{7}$$

Where $\tau_y$ is the fluid yield point and $d_s$ is the particle diameter. Then the apparent viscosity, $\mu_a$ as defined by Chien, Sze-Foo, "Laminar Flow Pressure Loss and Flow Pattern Transition of Bingham Plastics in Pipes and Annuli," Society of Petroleum Engineers (SPE2459 1968)(see Chien, equation 49):

$$\mu_a = \mu_p + 5\frac{\tau_y d_s}{v} \tag{8}$$

Where $\mu_p$ is the plastic viscosity, $\tau_y$ is defined in equation (7), and $\upsilon$ is kinematic velocity.

Based on the multiphase flow model the mixture density will be determined taking into account the slip velocity.

Today's UBD engineer is required to model the impact of cuttings loading for a complete hole section. Given the complexity of geological environments currently being drilled, modeling interlayer formations, including cutting loadings specific to those environments, will allow a more accurate prediction of bottom-hole pressure. These improved predictions will reduce risks associated with UBD drilling as well as improving drilling parameters, such as hole cleaning.

In one aspect, a method features preparing a model to drill a borehole with a bottom hole assembly ("BHA") through a plurality of formations including a first formation and a second formation. The method includes defining a first-formation formation top to be a depth at which the BHA will enter the first formation, a second-formation formation top to be a depth at which the BHA will enter the second formation, wherein the first-formation formation top is at a shallower depth than the second-formation formation top, a first-formation lithography for the first formation, and a second-formation lithography for the second formation. The method includes computing with a processor a first-formation operating envelop at the first-formation top within which a first-formation-bottom-hole pressure (FFBHP) in a first-formation annular volume within the borehole adjacent to the BHA as the BHA passes through the first-formation top is in an underbalanced condition, wherein the first-formation operating envelop is computed as a function of the lithography of the first formation. The method includes computing with the processor a second-formation operating envelop at the second-formation top within which a second-formation-bottom-hole pressure (SFBHP) in a second-formation annular volume within the borehole adjacent to the BHA as the BHA passes through the second-formation top is in an underbalanced condition, wherein the second-formation operating envelop is computed as a function of the lithography of the second formation. The method includes drilling the borehole according to the model. The method includes adjusting drilling parameters to keep the FFBHP within the first-formation operating envelop when drilling through the first formation, and to keep the SFBHP within the second-formation operating envelop when drilling through the second formation.

Implementations of the invention may include one or more of the following. FFBHP may be a function of a plurality of drilling parameters and a slip velocity of first-formation cuttings produced by the BHA from the first formation as it passes through the first formation. The slip velocity of first-formation cuttings produced by the BHA from the first formation as it passes through the first-formation top may be computed as a function of the dimensions of first-formation cuttings, the particle apparent velocity of first-formation cuttings, the shape, size, and sphericity of first-formation cuttings, and the particle flow regime of first-formation cuttings. The particle flow regime of first-formation cuttings may be selected from the group consisting of laminar flow and turbulent flow. The plurality of drilling parameters may include a liquid injection rate at which drilling fluids are injected into the well and a gas injection rate at which gas is injected into the well. SFBHP may be a function of a plurality of drilling parameters and a slip velocity of second-formation cuttings produced by the BHA from the second formation as it passes through the second formation. The slip velocity of second-formation cuttings produced by the BHA from the second formation as it passes through the second-formation top may be computed as a function of the dimensions of second-formation cuttings, the particle apparent velocity of second-formation cuttings, the shape, size, and sphericity of second-formation cuttings, and the particle flow regime of second-formation cuttings. The particle flow regime of second-formation cuttings may be selected from the group consisting of laminar flow and turbulent flow. The plurality of drilling parameters may include a liquid injection rate at which drilling fluids are injected into the well and a gas injection rate at which gas is injected into the well.

In one aspect a method features preparing a model to drill a borehole with a bottom hole assembly ("BHA") through a plurality of formations comprising a first formation and a second formation. The method includes defining a first depth to be a depth at which the BHA is passing through the first formation, a second depth to be a depth at which the BHA is passing through the second formation, wherein the first depth is at a shallower depth than the second depth, a first-formation lithography for the first formation, and a second-formation lithography for the second formation. The method includes computing with a processor a first-formation operating envelop within which a first-formation bottom hole pressure ("FFBHP") in a first-formation annular volume within the well adjacent to the BHA as the BHA passes through the first formation in an underbalanced condition, wherein the first-formation operating envelop is computed as a function of the lithography of the first formation. The method further includes computing with the processor a second-formation operating envelop within which a second-formation bottom hole pressure ("SFBHP") in a second-formation annular volume within the well adjacent to the BHA as the BHA passes through the second formation is in an underbalanced condition, wherein the second-formation operating envelop is computed as a function of the lithography of the second formation. The method further includes drilling the well according to the well-drilling plan. The method further includes adjusting drilling parameters to keep the well within the first-formation operating envelop when drilling through the first formation, and to keep the well within the second-formation operating envelop when drilling through the second formation.

Implementations of the invention may include one or more of the following. FFBHP may be a function of a plurality of drilling parameters and a slip velocity of first-formation cuttings produced by the BHA from the first formation as it passes through the first formation. The slip velocity of first-formation cuttings produced by the BHA from the first formation as it passes through the first depth may be computed as a function of the dimensions of first-formation cuttings, the particle apparent velocity of first-formation cuttings, the shape, size, and sphericity of first-formation cuttings, and the particle flow regime of first-formation cuttings. The particle flow regime of first-formation cuttings may be selected from the group consisting of laminar flow and turbulent flow. The plurality of drilling parameters may include a liquid injection rate at which drilling fluids are injected into the well and a gas injection rate at which gas is injected into the well. SFBHP may be a function of a plurality of drilling parameters and a slip velocity of second-formation cuttings produced by the BHA from the second formation as it passes through the second formation. The slip velocity of second-formation cuttings produced by the BHA from the second formation as it passes through the second depth may be computed as a function of the dimensions of second-formation cuttings, the particle apparent velocity of second-formation cuttings, the shape, size, and sphericity of second-formation cuttings, and the particle flow regime of second-formation cuttings. The particle flow regime of second-formation cuttings may be selected from the group consisting of laminar flow and turbulent flow. The plurality of drilling parameters may include a liquid injection rate at which drilling fluids are injected into the well and a gas injection rate at which gas is injected into the well.

In one aspect, a non-transitory computer-readable medium, on which is recorded a computer program that, when executed, performs a method including preparing a model to drill a borehole with a bottom hole assembly ("BHA") through a plurality of formations comprising a first formation and a second formation. The method includes defining a first-formation formation top to be a depth at which the BHA will enter the first formation, a second-formation formation top to be a depth at which the BHA will enter the second formation, wherein the first-formation formation top is at a shallower depth than the second-formation formation top, a first-formation lithography for the first formation, and a second-formation lithography for the second formation. The method includes computing with a processor a first-formation operating envelop at the first-formation top within which a first-formation-bottom-hole pressure (FFBHP) in a first-formation annular volume within the borehole adjacent to the BHA as the BHA passes through the first-formation top is in an underbalanced condition, wherein the first-formation operating envelop is computed as a function of the lithography of the first formation. The method includes computing with the processor a second-formation operating envelop at the second-formation top within which a second-formation-bottom-hole pressure (SFBHP) in a second-formation annular volume within the borehole adjacent to the BHA as the BHA passes through the second-formation top is in an underbalanced condition, wherein the second-formation operating envelop is computed as a function of the lithography of the second formation. The method includes drilling the borehole according to the model. The method includes adjusting drilling parameters to keep the FFBHP within the first-formation operating envelop when drilling through the first formation, and to keep the SFBHP within the second-formation operating envelop when drilling through the second formation.

Implementations of the invention may include one or more of the following. FFBHP may be a function of a plurality of drilling parameters and a slip velocity of first-formation cuttings produced by the BHA from the first formation as it passes through the first formation. The slip velocity of first-formation cuttings produced by the BHA from the first formation as it passes through the first-formation top may be computed as a function of the dimensions of first-formation cuttings, the particle apparent velocity of first-formation cuttings, the shape, size, and sphericity of first-formation cuttings, and the particle flow regime of first-formation cuttings. The particle flow regime of first-formation cuttings may be selected from the group consisting of laminar flow and turbulent flow. The plurality of drilling parameters may include a liquid injection rate at which drilling fluids are injected into the well and a gas injection rate at which gas is injected into the well. Computing the second-formation operating envelop may include computing with the processor a second-formation bottom hole pressure ("SFBHP") in the second-formation annular area as the BHA passes through the second-formation top, wherein SFBHP is a function of a plurality of drilling parameters and a slip velocity of second-formation cuttings produced by the BHA from the second formation as it passes through the second formation. The slip velocity of second-formation cuttings produced by the BHA from the second formation as it passes through the second-formation top may be computed as a function of the dimensions of second-formation cuttings, the particle apparent velocity of second-formation cuttings, the shape, size, and sphericity of second-formation cuttings, and the particle flow regime of second-formation cuttings. The particle flow regime of second-formation cuttings may be selected from the group consisting of laminar flow and turbulent flow. The plurality of drilling parameters may include a liquid injection rate at which drilling fluids are injected into the well and a gas injection rate at which gas is injected into the well.

In one aspect, a non-transitory computer-readable medium, on which is recorded a computer program that, when executed, performs a method including preparing a model to drill a borehole with a bottom hole assembly ("BHA") through a plurality of formations comprising a first formation and a second formation. The method includes defining a first depth to be a depth at which the BHA is passing through the first formation, a second depth to be a depth at which the BHA is passing through the second formation, wherein the first depth is at a shallower depth than the second depth, a first-formation lithography for the first formation, and a second-formation lithography for the second formation. The method includes computing with a processor a first-formation operating envelop within which a first-formation bottom hole pressure ("FFBHP") in a first-formation annular volume within the well adjacent to the BHA as the BHA passes through the first formation in an underbalanced condition, wherein the first-formation operating envelop is computed as a function of the lithography of the first formation. The method includes computing with the processor a second-formation operating envelop within which a second-formation bottom hole pressure ("SFBHP") in a second-formation annular volume within the well adjacent to the BHA as the BHA passes through the second formation is in an underbalanced condition, wherein the second-formation operating envelop is computed as a function of the lithography of the second formation. The method includes drilling the well according to the well-drilling plan. The method includes adjusting drilling parameters to keep the well within the first-formation operating envelop when drilling through the first formation, and to keep the well within the second-formation operating envelop when drilling through the second formation.

Implementations may include one or more of the following. FFBHP may be a function of a plurality of drilling parameters and a slip velocity of first-formation cuttings produced by the BHA from the first formation as it passes through the first formation. The slip velocity of first-formation cuttings produced by the BHA from the first formation as it passes through the first depth may be computed as a function of the dimensions of first-formation cuttings, the particle apparent velocity of first-formation cuttings, the shape, size, and sphericity of first-formation cuttings, and the particle flow regime of first-formation cuttings. The particle flow regime of first-formation cuttings may be selected from the group consisting of laminar flow and turbulent flow. The plurality of drilling parameters may include a liquid injection rate at which drilling fluids are injected into the well and a gas injection rate at which gas is injected into the well. SFBHP may be a function of a plurality of drilling parameters and a slip velocity of second-formation cuttings produced by the BHA from the second formation as it passes through the second formation. The slip velocity of second-formation cuttings produced by the BHA from the second formation as it passes through the second depth is computed as a function of the dimensions of second-formation cuttings, the particle apparent velocity of second-formation cuttings, the shape, size, and sphericity of second-formation cuttings, and the particle flow regime of second-formation cuttings. The particle flow regime of second-formation cuttings may be selected from the group consisting of laminar flow and turbulent flow. The plurality of drilling parameters may include a liquid injection rate at which drilling fluids are injected into the well and a gas injection rate at which gas is injected into the well.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A method comprising:

preparing a model to drill a borehole with a bottom hole assembly ("BHA") through a plurality of formations comprising a first formation and a second formation;

defining:

a first-formation formation top to be a depth at which the BHA will enter the first formation, a second-formation formation top to be a depth at which the BHA will enter the second formation, wherein the first-formation formation top is at a shallower depth than the second-formation formation top, a first-formation lithography for the first formation, and a second-formation lithography for the second formation;

computing with a processor a first-formation operating envelop at the first-formation top within which a first-formation-bottom-hole pressure (FFBHP) in a first-formation annular volume within the borehole adjacent to the BHA as the BHA passes through the first-formation top is in an underbalanced condition, wherein the first-formation operating envelop is computed as a function of the lithography of the first formation;

computing with the processor a second-formation operating envelop at the second-formation top within which a second-formation-bottom-hole pressure (SFBHP) in a second-formation annular volume within the borehole adjacent to the BHA as the BHA passes through the second-formation top is in an underbalanced condition, wherein the second-formation operating envelop is computed as a function of the lithography of the second formation;

drilling the borehole according to the model; and adjusting drilling parameters:

to keep the FFBHP within the first-formation operating envelop when drilling through the first formation, and to keep the SFBHP within the second-formation operating envelop when drilling through the second formation.

2. The method of claim 1 wherein FFBHP is a function of a plurality of drilling parameters and a slip velocity of first-formation cuttings produced by the BHA from the first formation as it passes through the first formation.

3. The method of claim 2 wherein the slip velocity of first-formation cuttings produced by the BHA from the first formation as it passes through the first-formation top is computed as a function of:

the dimensions of first-formation cuttings;

the particle apparent velocity of first-formation cuttings;

the shape, size, and sphericity of first-formation cuttings; and the particle flow regime of first-formation cuttings.

4. The method of claim 2 wherein the plurality of drilling parameters comprises:

a liquid injection rate at which drilling fluids are injected into the well; and a gas injection rate at which gas is injected into the well.

5. The method of claim 1 wherein SFBHP is a function of a plurality of drilling parameters and a slip velocity of second-formation cuttings produced by the BHA from the second formation as it passes through the second formation.

6. The method of claim 5 wherein the slip velocity of second-formation cuttings produced by the BHA from the second formation as it passes through the second-formation top is computed as a function of:

the dimensions of second-formation cuttings;

the particle apparent velocity of second-formation cuttings;

the shape, size, and sphericity of second-formation cuttings; and the particle flow regime of second-formation cuttings.

7. The method of claim 6 wherein the particle flow regime of second-formation cuttings is selected from the group consisting of laminar flow and turbulent flow.

8. The method of claim 5 wherein the plurality of drilling parameters comprises:

a liquid injection rate at which drilling fluids are injected into the well; and a gas injection rate at which gas is injected into the well.

9. A method comprising:

preparing a model to drill a borehole with a bottom hole assembly ("BHA") through a plurality of formations comprising a first formation and a second formation;

defining:

a first depth to be a depth at which the BHA is passing through the first formation, a second depth to be a depth at which the BHA is passing through the second formation, wherein the first depth is at a shallower depth than the second depth, a first-formation lithography for the first formation, and a second-formation lithography for the second formation;

computing with a processor a first-formation operating envelop within which a first-formation bottom hole pressure ("FFBHP") in a first-formation annular volume within the well adjacent to the BHA as the BHA passes through the first formation in an underbalanced condition, wherein the first-formation operating envelop is computed as a function of the lithography of the first formation;

computing with the processor a second-formation operating envelop within which a second-formation bottom hole pressure ("SFBHP") in a second-formation annular volume within the well adjacent to the BHA as the BHA passes through the second formation is in an underbalanced condition, wherein the second-formation operating envelop is computed as a function of the lithography of the second formation;

drilling the well according to the well-drilling plan; and adjusting drilling parameters:

to keep the well within the first-formation operating envelop when drilling through the first formation, and to keep the well within the second-formation operating envelop when drilling through the second formation.

10. The method of claim 9 wherein FFBHP is a function of a plurality of drilling parameters and a slip velocity of first-formation cuttings produced by the BHA from the first formation as it passes through the first formation.

11. The method of claim 10 wherein the slip velocity of first-formation cuttings produced by the BHA from the first formation as it passes through the first depth is computed as a function of:

the dimensions of first-formation cuttings;

the particle apparent velocity of first-formation cuttings;

the shape, size, and sphericity of first-formation cuttings; and the particle flow regime of first-formation cuttings.

12. The method of claim 10 wherein the plurality of drilling parameters comprises:

a liquid injection rate at which drilling fluids are injected into the well; and a gas injection rate at which gas is injected into the well.

13. The method of claim 9 wherein SFBHP is a function of a plurality of drilling parameters and a slip velocity of second-formation cuttings produced by the BHA from the second formation as it passes through the second formation.

14. The method of claim 13 wherein the slip velocity of second-formation cuttings produced by the BHA from the second formation as it passes through the second depth is computed as a function of:

the dimensions of second-formation cuttings;

the particle apparent velocity of second-formation cuttings;

the shape, size, and sphericity of second-formation cuttings; and the particle flow regime of second-formation cuttings.

15. The method of claim 14 wherein the particle flow regime of second-formation cuttings is selected from the group consisting of laminar flow and turbulent flow.

16. The method of claim 13 wherein the plurality of drilling parameters comprises:

a liquid injection rate at which drilling fluids are injected into the well; and a gas injection rate at which gas is injected into the well.

17. A non-transitory computer-readable medium, on which is recorded a computer program that, when executed, performs a method comprising:

preparing a model to drill a borehole with a bottom hole assembly ("BHA") through a plurality of formations comprising a first formation and a second formation;

defining:

a first-formation formation top to be a depth at which the BHA will enter the first formation, a second-formation formation top to be a depth at which the BHA will enter the second formation, wherein the first-formation formation top is at a shallower depth than the second-formation formation top, a first-formation lithography for the first formation, and a second-formation lithography for the second formation;

computing with a processor a first-formation operating envelop at the first-formation top within which a first-formation-bottom-hole pressure (FFBHP) in a first-formation annular volume within the borehole adjacent to the BHA as the BHA passes through the first-formation top is in an underbalanced condition, wherein the first-formation operating envelop is computed as a function of the lithography of the first formation;

computing with the processor a second-formation operating envelop at the second-formation top within which a second-formation-bottom-hole pressure (SFBHP) in a second-formation annular volume within the borehole adjacent to the BHA as the BHA passes through the second-formation top is in an underbalanced condition, wherein the second-formation operating envelop is computed as a function of the lithography of the second formation;

drilling the borehole according to the model; and adjusting drilling parameters:

to keep the FFBHP within the first-formation operating envelop when drilling through the first formation, and to keep the SFBHP within the second-formation operating envelop when drilling through the second formation.

18. The non-transitory computer-readable medium of claim 17 wherein FFBHP is a function of a plurality of drilling parameters and a slip velocity of first-formation cuttings produced by the BHA from the first formation as it passes through the first formation.

19. The non-transitory computer-readable medium of claim 17 wherein computing the second-formation operating envelop comprises computing with the processor a second-formation bottom hole pressure ("SFBHP") in the second-formation annular area as the BHA passes through the second-formation top, wherein SFBHP is a function of a plurality of drilling parameters and a slip velocity of second-formation cuttings produced by the BHA from the second formation as it passes through the second formation.

20. The non-transitory computer-readable medium of claim 19 wherein the slip velocity of second-formation cuttings produced by the BHA from the second formation as it passes through the second-formation top is computed as a function of:

the dimensions of second-formation cuttings;

the particle apparent velocity of second-formation cuttings;

the shape, size, and sphericity of second-formation cuttings; and the particle flow regime of second-formation cuttings.

* * * * *